US005275212A

United States Patent [19]

Moris

[11] Patent Number: 5,275,212

[45] Date of Patent: Jan. 4, 1994

[54] AEROSOL FILLING METHOD

[75] Inventor: Robert A. Moris, Lino Lakes, Minn.

[73] Assignee: Minnesota Mining and Manufacturing Company, St. Paul, Minn.

[21] Appl. No.: 22,335

[22] Filed: Feb. 24, 1993

[51] Int. Cl.[5] ..... B65B 1/04; B65B 3/04

[52] U.S. Cl. ..... 141/3; 141/20; 141/82; 141/11

[58] Field of Search ..... 141/3, 4, 5, 20, 82, 141/11

[56] References Cited

U.S. PATENT DOCUMENTS 3,502,118 3/1970 Assalit ..... 141/20

4,921,020 5/1990 Pamper ..... 141/20

*Primary Examiner*—Ernest G. Cusick

*Assistant Examiner*—Steven O. Douglas

*Attorney, Agent, or Firm*—Gary L. Griswold; Walter N. Kirn; Douglas E. Reedich

[57] ABSTRACT

A process for preparing a medicinal aerosol formulation containing a propellant that is gaseous at standard temperature and pressure and filling the formulation into a metered dose aerosol canister. The process involves mixing the propellant and the drug at ambient temperature and under pressure sufficient to liquify the propellant to afford a formulation. The formulation is cooled to a temperature sufficiently low to liquify the propellant at atmospheric pressure and filled into aerosol canisters in an environment of controlled humidity. An aerosol valve is placed on each aerosol canister and the finished canisters are removed from the controlled environment.

6 Claims, 1 Drawing Sheet

AEROSOL FILLING METHOD

BACKGROUND OF THE INVENTION

1. Field of the Invention

This invention relates to aerosol drug formulations. This invention also relates to methods of preparing aerosol drug formulations and to methods of filling aerosol canisters.

2. Description of the Related Art

Conventional chlorofluorocarbon based medicinal aerosol formulations generally contain a relatively nonvolatile component (e.g., trichlorofluoromethane, propellant 11), a surfactant, a drug, and a volatile propellant system (e.g., a combination of dichlorodifluoromethane, propellant 12, and dichlorotetrafluoroethane, propellant 114). Such formulations can be filled into individual aerosol canisters by one of two conventional methods: pressure filling or cold filling. Cold filling generally involves the preparation of a mixture of the nonvolatile components at room temperature and ambient pressure to form a concentrate. This concentrate is then cooled to a temperature at which the remaining components are liquid at ambient pressure. The volatile components are also cooled and added to the concentrate to afford a liquid formulation that is filled into individual canisters, also at reduced temperature. A valve is crimped into place on the canister and the finished product is allowed to warm to ambient temperature.

Pressure filling involves the same preparation of a concentrate of the nonvolatile components. An appropriate amount of the concentrate is metered into an individual canister at ambient temperature and pressure. A valve is then crimped into place. The volatile components are then added to the canister via the valve under pressure sufficient to liquify the volatile components.

European Patent Application 0,419,261 (Burt et al.) describes a method of introducing into a container a suspension or solution of a material in a propellant held under pressure. The method comprises bringing a filling head into communication with a container, introducing a quantity of the suspension or solution into the container through the filling head, introducing a quantity of a high pressure propellant into the filling head while it is still in communication with the container, thereby flushing through any suspension or solution remaining in the filling head. This pressure filling method is said to avoid the escape of pharmaceutical material when the filling head is removed from the container.

SUMMARY OF THE INVENTION

This invention provides a process for preparing a medicinal aerosol formulation comprising a drug and a propellant that is gaseous at standard temperature and pressure and filling the formulation into an aerosol canister, comprising the steps of:

(i) mixing the propellant and the drug at ambient temperature and under pressure sufficient to liquify the propellant;

(ii) optionally adding additional propellant to the mixture from step (i) in an amount sufficient to bring the formulation to a predetermined concentration of drug;

(iii) cooling the formulation from step (ii) to a temperature sufficiently low to liquify the propellant at atmospheric pressure;

(iv) providing a controlled environment having humidity sufficiently low to prevent condensation of water vapor at the temperature of step (iii);

(v) filling a predetermined amount of the formulation from step (iii) into an aerosol canister in a controlled environment according to step (iv);

(vi) placing an aerosol valve on the aerosol canister in a controlled environment according to step (iv); and (vii) removing the aerosol canister from the controlled environment.

Conventional aerosol formulations can be prepared using the process of the invention. However, in all steps the process of the invention maintains the formulation in a closed system that eliminates the ingress of water into the formulation and under conditions wherein the volatile propellant components are liquified. This invention therefore affords a cold filling process that is particularly suitable for use in preparing medicinal aerosol formulations that do not contain components such as relatively nonvolatile liquid propellants or adjuvants that are suitable for use in forming a liquid concentrate at ambient temperature and pressure.

DETAILED DESCRIPTION OF THE INVENTION

Figure 1:
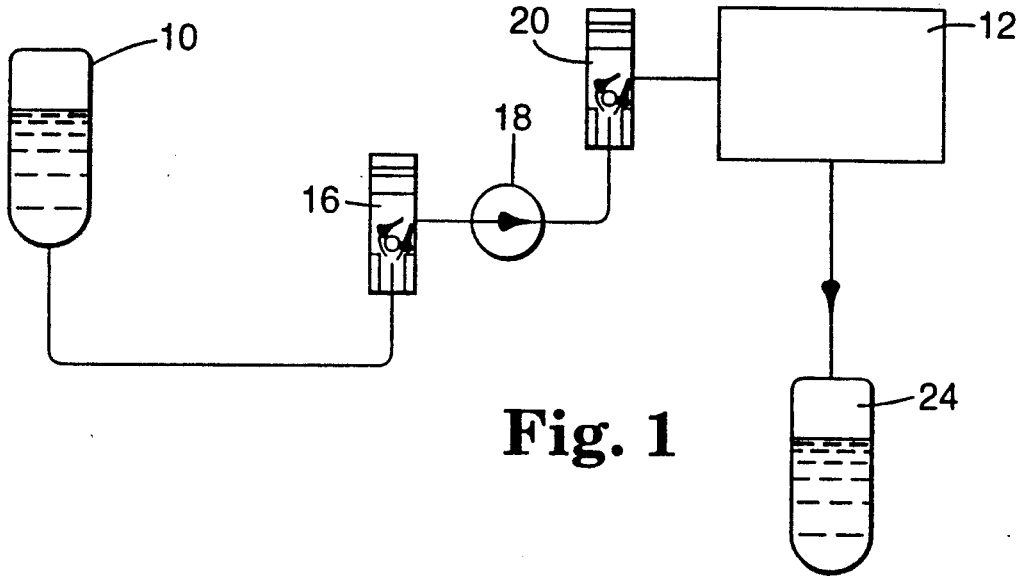

A medicinal aerosol formulation comprises a propellant that is gaseous at standard temperature and pressure. Materials suitable for use in the process of the invention include conventional chlorofluorocarbons that find use as components of aerosol formulations, such as propellant 12 (dichlorodifluoromethane), propellant 21 (dichlorofluoromethane), propellant 114 (1,2-dichloro-1,1,2,2-tetrafluoroethane), propellant **114*a* (1,1-dichloro-1,1,2,2-tetrafluoroethane), propellant 142*b* (1-chloro-1,1-difluoroethane), propellant 152*a* (1,1,-difluoroethane), and mixtures thereof such as mixtures of propellant 114 and propellant 12. Also suitable are hydrocarbon propellants such as propane, isobutane, and butane, fluorocarbons such as octafluoropropane and octafluorocyclobutane, dimethyl ether, and non-CFC propellants such as hydrofluoroalkanes, e.g., propellant 134*a* (1,1,1,2-tetrafluoroethane) and propellant 227** (1,1,1,2,3,3,3-heptafluoropropane).

Any drug suitable for administration by inhalation can be incorporated in a formulation according to the process of the invention. Such drugs include albuterol, atropine, beclomethasone, cromolyn, epinephrine, ephedrine, fentanyl, flunisolide, formoterol, ipratropium bromide, isoproterenol, pentamidine, pirbuterol, prednisolone, salmeterol, and pharmaceutically acceptable salts, clathrates, and solvates thereof. Particularly preferred drugs include pirbuterol acetate. If the formulation is a suspension formulation it is preferred that the drug be in the form of particles of respirable size (e.g., less than about 10 $\mu$m in diameter).

In step (i) of the process of the invention the drug and the propellant are combined at ambient temperature and under a pressure sufficient to liquify the propellant. Components of the formulation other than the propellant and the drug (e.g., surfactants or cosolvents) can also be added to the formulation in step (i). Ambient temperature as used herein designates a temperature above the boiling point of the propellant at atmospheric pressure. Step (i) is preferably carried out between about 0° C. to about 30° C. Pressure suitable to liquify the propellant will of course be dependent on the particular propellant. Suitable pressure can be determined by those skilled in the art and achieved readily using conventional pressure vessels and ancillary equipment. Step (i) can be carried out, e.g., in a vessel suitable for use at the pressures employed.

Generally, the mixing of components in step (i) can be carried out by any suitable conventional mixing technique, including stirring, ultrasonic vibration, and the like. In the case of a suspension formulation, however, it is preferred to break up any agglomerates of drug particles that might be present in the particulate drug. Accordingly, the drug and propellant (and any other components) are preferably combined in relative amounts that afford a mixture suitable for use in connection with a conventional homogenizer such as an orifice homogenizer. This mixture is then passed through the homogenizer. If the amount of propellant used in step (i) is less than the amount required to afford a formulation with the appropriate predetermined concentration of drug, additional propellant can be added as required to afford a bulk formulation.

In step (iii), the bulk formulation (still under pressure in order to liquify the propellant) is cooled to a temperature sufficiently low to liquify the propellant at atmospheric pressure. Suitable temperature will be dependent on the particular propellant, such temperature being readily determined by those skilled in the art. Preferably the bulk formulation is cooled to a temperature at least about 30° C. below the boiling point (at atmospheric pressure) of the most volatile component of the formulation. Generally for use with common CFC propellants and with propellant 134*a*, a temperature of less than about −30° C., preferably about −50° C. to −65° C., is suitable. Cooling can be done in any suitable manner. For example, certain commercially available pressure vessels have cooling jackets through which a thermal transfer fluid can be circulated in order to cool the contents of the vessel.

It is necessary in step (iv) to provide a controlled environment. It is well known that certain drugs and/or aerosol formulations containing them are sensitive to water. Accordingly, the controlled environment is a controlled humidity environment from which water vapor does not condense at the temperature of the bulk formulation from step (iii). Such an environment can be provided readily by using conventional refrigeration technology in combination with purging or blanketing with an atmosphere of dry air or another dry gas such as nitrogen or argon. In this environment the cooled bulk formulation can be exposed without concern for excessive condensation of water vapor. The temperature of the controlled environment is not unduly critical so long as it is cool enough to maintain the volatile propellant components in the liquid state for the period of time (several seconds, e.g., three seconds or less) that the formulation is exposed to the controlled atmosphere as described below in connection with step (v). It has been found to be suitable for the controlled environment to be as much as 80° C. warmer than the temperature of the bulk formulation. Preferably the pressure in the controlled environment is substantially atmospheric pressure.

In step (v) predetermined amounts of the bulk formulation are metered from the bulk formulation and into individual aerosol canisters, preferably open aerosol canisters, in the environment of step (iv). It is common for suspension aerosol formulations to settle or cream over a time period of several seconds if they are left unagitated. In order to assure homogeneous sampling from a bulk suspension formulation it is therefore often necessary or desirable to agitate the bulk formulation during metering into the individual aerosol canisters. Generally the vessel containing the bulk formulation is connected by way of appropriate ancillary lines to filling head which dispenses the formulation into aerosol canisters as they are brought into communication with the filling head. These ancillary lines can be configured to recirculate the bulk formulation from the filling head back to the vessel containing the bulk formulation in order to maintain homogeneity of the bulk formulation.

When the bulk formulation is exposed to a controlled environment according to step (iv) water vapor does not condense into the formulation or into the aerosol canister. Furthermore, the volatile propellants remain in the liquid phase and the individual canisters containing the formulation can be manipulated for up to several seconds as needed in this environment without concern for loss of propellant through evaporation.

In step (vi) a conventional aerosol valve, e.g., a metered dose valve, is placed on the filled aerosol canister from step (v) to provide an aerosol canister containing a medicinal aerosol formulation, and in step (vii) the canister is removed from the controlled environment.

Figure 2:
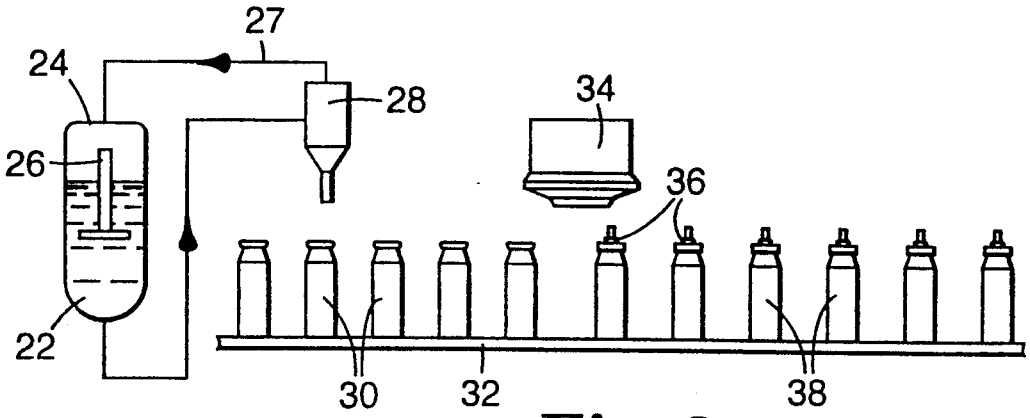

The invention will be described with reference to the Drawing, in which:

FIG. 1 is a schematic representation of step (i) of the process of the invention, and FIG. 2 is a schematic representation of step (ii) through step (vii) of the process of the invention.

Referring to FIG. 1, drug, propellant, and any other components of a medicinal aerosol formulation are combined under pressure in pressure vessel 10 in amounts suitable for use in connection with conventional homogenizer 12. The pressure in pressure vessel 10 advances the liquid mixture through check valve 16 to high pressure pump 18. Pump 18 advances the liquid mixture through a homogenizer. In one embodiment a simple check valve set to open at an appropriate pressure (e.g., about 1500 psi, or 105 Kg/cm$^2$) can function as a homogenizer. In the illustrated embodiment, pump 18 advances the liquid mixture through check valve 20 into homogenizer 12, where it is forced at high pressure through small openings of a homogenizing valve in homogenizer 12. Suitable homogenizers include those described in Kirk Othmer Encyclopedia of Science and Technology, third edition, volume 15, page 528–530, Wiley Interscience 1978, incorporated herein by reference. After passing through the homogenizer the liquid mixture, still under pressure, is collected in pressure vessel 24. The amount of propellant in pressure vessel 24 can then be adjusted if necessary by adding propellant in order to bring the bulk formulation (22) to the appropriate concentration.

Referring to FIG. 2, pressure vessel 24 and the bulk formulation therein are cooled to a temperature sufficiently low to liquify the propellant at atmospheric pressure. Pressure vessel 24 is equipped with an agitator 26 in order to assure homogeneous sampling from the formulation. Pressure vessel 24 is also equipped with flow lines 27 that circulate bulk formulation 22 continuously through metered filling head 28, which is constructed and arranged to fill open aerosol canisters 30 as they are moved into position sequentially by indexing table 32. The remainder of the illustrated process is carried out in the controlled environment described above in connection with step (iv) of the process of the invention. Metered amounts of the formulation are filled into aerosol canisters 30 using conventional cold filling techniques as the canisters are brought into communication with filling head 28. Indexing table 32 carries the filled canisters on to valve crimping head 34, which secures a valve 36 onto each canister. The finished canisters 38 are then held by the indexing table until all canisters are filled and equipped with a valve. The finished canisters are then removed from the controlled atmosphere for further processing (e.g., labeling and packaging operations.

The following examples are provided in order to illustrate the process of the invention. Various alterations to the illustrated embodiments will be apparent to those skilled in the art without departing from the scope of the invention.

EXAMPLE 1

Under a nitrogen atmosphere, micronized pentamidine isethionate (392.0 g) and oleic acid (56.0 g) were placed in a 1 gallon (3.8 L) pressure vessel (available from Pope Scientific Inc., Menomonee Falls, Wis.), referred to below as the concentrate vessel, equipped with a magnetic stir bar and the vessel was sealed. Propellant 12 (dichlorodifluoromethane, 3,263 g) was added to the concentrate vessel via a propellant pump (Pamasol, Wille Mader AG, Switzerland). Propellant 12 (999 g) was added to a second 1 gallon (3.8 L) pressure vessel, referred to below as the rinse vessel, via the propellant pump. The concentrate vessel was placed on a magnetic stir platform and the stir bar within the vessel was activated. The contents of the concentrate vessel were transferred with homogenizing to a 6 gallon (22.7 L) pressure vessel equipped with a temperature jacket and an air driven mixer, referred to below as the formulation vessel, by pumping (pump from Bran+-Lubbe, Buffalo Grove, Ill.) the contents through a check valve (available from Nupro, Willoughby, Ohio) operating at 1500 psi (105 Kg/cm$^2$) gauge pressure. The tubing, pump and check valve were immediately flushed with Propellant 12 from the rinse vessel until the tubing was visually clear of pentamidine isethionate particles. The concentrate vessel was charged with propellant 12 (1,131 g) via the propellant pump, the magnetic stir bar was activated, the contents of the concentrate vessel were again transferred to the formulation vessel by pumping through the check valve operating at a pressure of 1500 p.s.i.g., then the tubing, pump and valve were again flushed with Propellant 12 from the rinse vessel until the tubing was visually clear of pentamidine isethionate particles. This procedure was repeated three additional times using 1,046 g, 1,388 g, and 1,187 g of propellant 12 respectively. The concentrate vessel was disconnected and was found by visual inspection to be free of pentamidine isethionate particles. The formulation vessel was charged with additional Propellant 12 (46,131 g) via the propellant pump and the mixer was engaged. The formulation vessel was then chilled via circulation of cold thermal transfer fluid through the vessel jacket. When the temperature had fallen to below −35° C., the formulation was cold filled under a nitrogen atmosphere into aluminum aerosol vials (available from 3M Company, St. Paul, Minn.). The vials were then sealed with 50 μL suspension valves (available from 3M Company, St. Paul, Minn.).

EXAMPLE 2

Micronized isoproterenol hydrochloride (12.5 g) and sorbitan trioleate (Span TM 85, 5.0 g; ICI Americas, Inc.) were placed in a 1 gallon (3.8 L) pressure vessel, referred to below as the supply vessel, equipped with a magnetic stirrer and the vessel was sealed. Propellant 12 (983 g) was added to the vessel through a condenser coil. The vessel was allowed to warm to ambient temperature while stirring the contents to allow for solubilization of the sorbitan trioleate in the propellant. The contents of the supply vessel were transferred with homogenizing to a 1 gallon (3.8 L) pressure vessel, referred to below as the receiving vessel, by pumping (Bran+Lubbe pump) through a check valve set at 1500 psi (105 Kg/cm$^2$) gauge pressure. After the transfer was complete, the receiving vessel was chilled in dry ice. The chilled formulation was then cold-filled into aluminum aerosol vials which were subsequently sealed with 50 μL suspension valves.

EXAMPLE 3

Ethanol (247 g) and oleic acid (2.5 g) were placed in a 1 gallon (3.8 L) pressure vessel, referred to below as the holding vessel, equipped with a magnetic stir bar. The holding vessel was sealed then charged with HFC **134*a* (1,1,1,2-tetrafluoroethane, 251 g) using a Pamasol propellant pump. A second 1 gallon (3.8 L) pressure vessel, referred to below as the rinse vessel, was charged with HFC 134*a* (692 g) using the propellant pump. Micronized pirbuterol acetate (14.9 g) was placed in a 240 mL pressure vessel, referred to below as the donor vessel, equipped with a magnetic stir bar and the vessel was sealed. The contents of the holding vessel were stirred for 20 minutes until the pressure had stabilized at 48 psi (3.4 Kg/cm$^2$) gauge pressure. Using nitrogen pressure, 93 g of the ethanol/oleic acid/HFC 134*a* mixture was transferred from the holding vessel into the donor vessel. The magnetic stir bar in the donor vessel was activated immediately. The donor vessel was connected to an in-line homogenizer (Bran+Lubbe pump with a Nupro TM check valve set at 1500 psi (105 Kg/cm$^2$) gauge pressure). The homogenizer and tubing were primed with HFC 134*a* from the rinse vessel then the contents of the donor vessel were transferred with homogenizing to a 1 gallon (3.8 L) pressure vessel equipped with a magnetic stir bar, referred to below as the receiving vessel. The donor vessel, homogenizer and tubing were flushed with HFC 134*a* from the rinse vessel until the rinse was visually clear of pirbuterol acetate particles All rinses went into the receiving vessel. The receiving vessel was charged with additional HFC 134*a*** (1019 g) using a propellant pump. The stir bar in the receiving vessel was activated then the vessel was chilled with dry ice. The chilled formulation was then cold-filled under a nitrogen atmosphere into aluminum aerosol vials which were subsequently sealed with 25 μL valves.

The claimed invention is:

1. A process for preparing a medicinal aerosol formulation comprising a drug and a propellant that is gaseous at standard temperature and pressure and filling the formulation into an aerosol canister, comprising the steps of:

(i) mixing the propellant and the drug at ambient temperature and under pressure sufficient to liquify the propellant;

(ii) optionally adding additional propellant to the mixture from step (i) in an amount sufficient to bring the formulation to a predetermined concentration of drug;

(iii) cooling the formulation from step (ii) to a temperature sufficiently low to liquify the propellant at atmospheric pressure;

(iv) providing a controlled environment having humidity sufficiently low to prevent condensation of water vapor at the temperature of step (iii);

(v) filling the predetermined amount of the formulation from step (iii) into an aerosol canister in the controlled environment according to step (iv);

(vi) placing an aerosol valve on the aerosol canister in a controlled environment according to step (iv); and (vii) removing the aerosol canister from the controlled environment.

2. A process according to claim 1 wherein the propellant is propellant 134*a*, propellant 227, or a mixture thereof.

3. A process according to claim 1 wherein the formulation is substantially free of adjuvants and propellants that are liquid at standard temperature and pressure.

4. A process according to claim 1, wherein the formulation is a suspension formulation.

5. A process according to claim 1, wherein the mixing of step (i) is carried out in a homogenizer

6. A process according to claim 5, wherein the homogenizer is an orifice homogenizer.

* * * * *